US007515852B2

(12) United States Patent
Nakamura et al.

(10) Patent No.: US 7,515,852 B2
(45) Date of Patent: Apr. 7, 2009

(54) CONDUCTIVE MEMBER, CHARGING MEMBER USING THE CONDUCTIVE MEMBER, PROCESS CARTRIDGE USING THE CHARGING MEMBER AND IMAGE FORMING APPARATUS USING PROCESS CARTRIDGE

(75) Inventors: Makoto Nakamura, Ebina (JP); Yutaka Narita, Sagamihara (JP); Tadayuki Oshima, Atsugi (JP); Tadaaki Hattori, Hadano (JP); Toshio Kojima, Isehara (JP); Taisuke Tokuwaki, Sagamihara (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 11/594,998

(22) Filed: Nov. 9, 2006

(65) Prior Publication Data

US 2007/0116493 A1 May 24, 2007

(30) Foreign Application Priority Data

Nov. 10, 2005 (JP) ..... 2005-326049

(51) Int. Cl.
*G03G 15/02* (2006.01)

(52) U.S. Cl. ..... 399/176

(58) Field of Classification Search ..... 399/107, 399/111, 115, 168, 174, 176; 430/69
See application file for complete search history.

(56) References Cited

U.S. PATENT DOCUMENTS

2005/0100365 A1 5/2005 Narita et al.
2008/0038016 A1* 2/2008 Tokuwaki et al. ..... 399/168
2008/0044751 A1* 2/2008 Nakamura et al. ..... 430/69

FOREIGN PATENT DOCUMENTS

| | | |
|---|---|---|
| EP | 0690360 | 1/1996 |
| JP | 63-149668 | 6/1988 |
| JP | 01-211779 | 8/1989 |
| JP | 01-267667 | 10/1989 |
| JP | 03-240076 | 10/1991 |
| JP | 2002-311687 | 10/2002 |
| JP | 2004-151534 | 5/2004 |
| JP | 2004-341302 | 12/2004 |
| JP | 2005-024830 | 1/2005 |
| JP | 2005-025021 | 1/2005 |
| JP | 2005-091818 | 4/2005 |

OTHER PUBLICATIONS

European Patent Office Search Report dated Feb. 15, 2007, for corresponding European Patent Application No. EP 06023331.

* cited by examiner

*Primary Examiner*—Hoan H Tran
(74) *Attorney, Agent, or Firm*—Harness, Dickey & Pierce PLC

(57) ABSTRACT

An conductive member includes a long conductive supporting body to which a predetermined potential is applied, extending from one side to the other side, an electric resistance adjusting layer, which is formed to surround a circumference surface of the conductive supporting body and adjusts an electric resistance, and a surface protection layer, which is provided to cover a surface of the electric resistance adjusting layer and protects the surface of the electric resistance adjusting layer, and the electric resistance adjusting layer contains a thermoplastic resin material having an ether group in a molecular and an organic phosphonium salt.

22 Claims, 5 Drawing Sheets

CONDUCTIVE MEMBER, CHARGING MEMBER USING THE CONDUCTIVE MEMBER, PROCESS CARTRIDGE USING THE CHARGING MEMBER AND IMAGE FORMING APPARATUS USING PROCESS CARTRIDGE

BACKGROUND

The present invention relates to a conductive member, a charging member using the conductive member, a process cartridge using the charging member and an image forming apparatus using the process cartridge.

For an image forming apparatus of electrophotographic type such as a copying machine, laser beam printer or facsimile, there has been utilized a conductive member as a charging member, which performs a charging process to a photoreceptor drum (image carrier), or as a transfer member, which performs a transfer process to toner on a photoreceptor drum.

FIG. 1 shows a schematic view of an image forming apparatus. The image forming apparatus 1 comprises a photoreceptor drum 4 as an image carrier in which an electrostatic latent image is formed, a charging roller 2 as a charging member which performs a charging process to the photoreceptor drum 4, a power pack (voltage applying source) 3 which applies voltage to the charging roller 2, a surface potential meter 5 which measures the surface potential of photoreceptor drum 4, a development roller 6 which transfers toner to the electrostatic latent image of the photoreceptor drum 4, a transfer roller 7 which transfers the toner image on the photoreceptor drum 4 to a recording paper S, and a cleaning device 8 which cleans the photoreceptor drum 4 after being transferred. In addition, as shown in FIG. 2, a process cartridge 9 having the photoreceptor drum 4, charging roller 2, development roller 6 and cleaning device 8 may be disposed in the image forming apparatus 1.

The charging roller 2 receives electric supply from the power pack 3 to charge the photoreceptor drum 4 at predetermined potential. The photoreceptor drum 4 rotates in the arrow A direction by means of a driving mechanism (not shown). The surface potential meter 5 is disposed just after the charging roller 2 along the rotation direction so as to measure the potential of a surface 4*a* of the photoreceptor drum 4.

The development roller 6 transfers the toner to the charged photoreceptor drum 4. The transfer roller 7 transfers the toner, which is transferred to the photoreceptor drum 4, to the recording paper S. The cleaning device 8 eliminates the toner stayed on the photoreceptor drum 4 so as to clean the photoreceptor drum 4.

In an image forming process by the image forming apparatus 1, at first, the surface 4*a* of photoreceptor drum 4 is charged by the charging roller 2 at negative high potential. Next, the surface 4*a* is exposed. By this exposure L, each potential on the surface 4*a* becomes potential distribution according to the amount of light received; thereby, the electrostatic latent image is formed on the surface 4*a*.

If a part of the surface 4*a* on which the electrostatic latent image is formed passes through the development roller 6 by the rotation of photoreceptor drum 4, the toner is transferred to the surface 4*a* according to the potential distribution of the surface 4*a*; thereby, the electrostatic latent image is visualized as the toner image. This toner image is transferred to the recording paper S, which is fed at predetermined timing, by the transfer roller 7, and then the recording paper S is fed in the arrow B direction toward a fixing unit (not shown).

On the other hand, after the transfer, the toner stayed on the surface 4*a* is eliminated by the cleaning device 8 to clean the photoreceptor drum 4, and also the charge is eliminated by a quenching lamp (not shown) to move on to a next image forming process.

As a general charging method in the above image forming apparatus 1, there has been known a contact charging method which brings the charging roller 2 into contact with the photoreceptor drum 4 (for example, reference to JP S63-149668A, JP H01-211779A and JP H01-267667A).

However, the charging roller 2 including the contact charging method has the following problems.

(1) The component of charging roller oozes from the charging roller, and the oozed component is firmly fixed to the surface of photoreceptor drum. If the fixation is developed, the charging roller track stays on the surface of photoreceptor drum.

(2) When applying alternating voltage to the charging roller 2, the charging roller which has contact with the photoreceptor drum vibrates, causing the charging noise.

(3) The toner on the surface of photoreceptor drum is firmly fixed to the charging roller, causing a decrease in the charging performance. Especially, if the component of charging roller oozes as described in (1), the toner is firmly fixed to the charging roller easily.

(4) The component comprising the charging roller is firmly fixed to the photoreceptor easily.

(5) If the photoreceptor is not driven for a long period of time, the charging roller permanently deforms.

In order to handle the above problems, there has been considered a proximity charging method which brings the charging roller 2 close to the photoreceptor drum 4 without bringing the charging roller 2 into contact with the photoreceptor drum 4 (reference to JP H03-240076A, etc.). In this proximity charging method, the charging roller 2 faces the photoreceptor drum 4, such that the distance of closest approach (hereinafter referred to as a space) between the charging roller 2 and the photoreceptor drum 4 becomes 50 μm-300 μm, to charge the photoreceptor drum 4 by applying voltage to the charging roller 2.

Since the charging roller 2 does not have contact with the photoreceptor drum 4 in the proximity charging method, the proximity charging method does not cause "the fixation of the component of charging roller to the photoreceptor" and "the permanent deformation of the charging roller caused by a long period of time nonuse" which are the problems of the contact charging method. In addition, regarding "the decrease in the charging performance of charging roller caused by the fixation of toner", the proximity charging method is superior to the contact charging method because the amount of toner which is firmly fixed to the charging roller decreases.

In a non-contact charging method, since the charging roller does not have contact with the photoreceptor drum, an elastic body is not required. Therefore, a hardening thermoplastic resin can be used.

Thereby, the space between the photoreceptor and the charging roller can be uniformed. There has been known that the charging mechanism of the surface of photoreceptor drum by the charging roller is discharge according to Paschen's law by micro discharge between the charging roller and the photoreceptor drum. In order to obtain a function which maintains the photoreceptor drum at a predetermined charging potential, it is necessary to control an electric resistance value of thermoplastic resin at a semi-conductive range (about $10^6$ Ωcm-$10^9$ Ωcm).

As a method of controlling an electric resistance value, there has been known a method of dispersing a conductive pigment such as a carbon black into a thermoplastic resin. However, if an electric resistance adjusting layer is set to a semi-conductive range by using the conductive pigment, the variations in the electric resistance value increase; thereby, a local charging defect occurs, or local discharge (leakage discharge) occurs due to the electronic conduction, resulting in an image defect.

On the other hand, by using an ionic conductive material as another method of controlling an electric resistance value, the variations in the electric resistance value decrease and also the local leakage which is caused when using the electronic conduction system can be prevented. Accordingly, the charging defect can be prevented.

The ionic conductive material includes an electrolyte salt such as an alkali metal salt or an ammonium salt. However, such a salt is low-molecular weight having a property which easily bleeds out on a surface of matrix resin. As a result, if the bleeding-out occurs on the surface of charging roller, the toner is firmly fixed to the charging roller, causing an image defect. In addition, polarization is caused by the power distribution, so an electric resistance value increases by a temporal change.

Consequently, in order to avoid the bleeding-out, there has been proposed a charging roller using a high-molecular-weight ionic conductive material (JP2005-91818A). In this case, since the ionic conductive material is dispersed and fixed in a matrix resin, the bleeding-out hardly occurs on the surface of charging roller. A polyamide elastomer (PEEA) is mainly used as this type of high-molecular-weight ionic conductive material.

However, even though this type of high-molecular-weight ionic conductive material is used as a conductive member, a target low electric resistance value can not be obtained only with the high-molecular-weight ionic conductive material. In order to solve this problem, there has been considered to add a salt so as to obtain a preferable electric resistance value. In order to lower the electric resistance value, it is necessary for a salt to easily ion-dissociate.

For this purpose, a perchlorate is often used. Consequently, there has been considered to use a sodium perchlorate, a lithium perchlorate or the like. However, in case of using these, when the sodium perchlorate is ion-dissociated, a strong alkaline sodium hydroxide is generated by the reaction with the moisture in the air. Accordingly, the thermoplastic resin is deteriorated by a temporal change, causing a solvent crack.

In addition, there has been known a technique similar to the present invention disclosed in JP2002-311687, which adds an organic phosphonium salt into a thermoplastic resin.

SUMMARY

The present invention has been made in view of the above circumstances, and an object of the present invention is to provide a conductive member capable of achieving low resistance of an electric resistance adjusting layer and capable of preventing temporal deterioration in a thermoplastic resin and also preventing generation of a solvent crack; furthermore, to provide a charging member using the conductive member, a process cartridge using the charging member and an image forming apparatus using the process cartridge, which can easily obtain a target resistance value as an electric resistance adjusting layer while preventing temporal deterioration in a thermoplastic resin.

In order to achieve the above object, the present invention is directed an conductive member, comprising: a long conductive supporting body to which a predetermined potential is applied, extending from one side to the other side; an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt.

According to the above structure, since the organic phosphonium salt, which hardly ion-dissociate and does not generate an alkaline material when it is ion-dissociated, is contained in the electric resistance adjusting layer, it is possible to obtain a target resistance value as the conductive member, and also to prevent the deterioration in the resin because the alkaline material is not generated. Therefore, it is possible to prevent the temporal deterioration in the thermoplastic resin material when distributing power.

In accordance with an embodiment of the present invention, the thermoplastic resin material having the ether group comprises a polyether ester amide.

According to the above structure, the polyether ester amide is used as the thermoplastic resin material having the ether group, so it is possible to obtain a target resistance value as the conductive member and also to prevent a solvent crack resulting in a material generated by the ionic dissociation, without losing a machining process property.

In accordance with an embodiment of the present invention, the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

According to the above structure, since the mixture material, which is produced by kneading the thermoplastic resin having the ether group and the thermoplastic resin having the hardness higher than the thermoplastic resin having the ether group in the melting condition, is used, the machining process property can be further improved.

In accordance with an embodiment of the present invention, a thermoplastic resin, which contains a glycidylmethacrylate group as a compatible agent, is added to the kneaded product in the melting condition.

According to the above structure, since the thermoplastic resin containing the glycidylmethacrylate group is added as the compatible agent, it is possible to improve a dispersion property of the thermoplastic resin material having the ether group and the thermoplastic resin material having the hardness higher than the thermoplastic resin material having the ether group, and also further approach a target resistance value as the conductive member. In addition, strength in a weldline of the electric resistance adjusting layer formed by a molding process can be improved, so the generation of crack resulting in the deterioration in the resin when repeating the power distribution or continuing the power distribution.

In accordance with an embodiment of the present invention, a resin layer having a toner non-adhesive property is used for the surface protection layer.

According to the above structure, the surface protection layer is formed by using the resin material having the toner non-adhesive property, so it is possible to prevent the toner from adhering on the surface protection layer. Therefore, a stable quality image can be provided when using the conductive member to an image forming apparatus.

In accordance with an embodiment of the present invention, the electric resistance adjusting layer is used for adjusting a charging electric potential to be applied to an image carrier, and a pair of space retaining members, which retains a space formed between the image carrier and the surface protection layer, is provided in both end portions of the conductive supporting body, respectively.

According to the above structure, since the space retaining members are used to retain the non-contact state between the image carrier and the surface protection layer, it is possible to avoid the adhesion of the material comprising the conductive member to the image carrier and the deformation of conductive member caused by a long period of time nonuse.

In accordance with an embodiment of the present invention, each of the space retaining members is fastened to at least one of the conductive supporting body and the electric resistance adjusting layer.

According to the above structure, since the space retaining member is fastened to at least one of the conductive supporting body and the electric resistance adjusting layer, the relative rotation between the electric resistance adjusting layer and the space retaining member can be prevented when cutting the electric resistance adjusting layer and the space retaining member in the longitudinal direction of the electric resistance adjusting layer while rotating the conductive supporting body.

In accordance with an embodiment of the present invention, a primer process is applied to an adhesion plane of each of the space retaining members.

According to the above structure, it is possible to improve the adhesive strength of the space retaining member to at least one of the electric resistance adjusting layer and the conductive member.

In accordance with an embodiment of the present invention, the conductive supporting body comprises a cylindrical shape.

According to the above structure, since the local concentration of electric charge can be prevented, the conductive member life can be extended.

Also, the present invention is directed an conductive member, comprising: a long conductive supporting body to which a predetermined potential is applied, extending from one side to the other side; an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

According to the above structure, since the electric resistance adjusting layer is formed by using the mixture product which is produced by kneading the thermoplastic resin material of the low water absorption, which has the ether group in the molecular, and the thermoplastic resin material of the high water absorption, which has the ether group in the molecular, in the melting condition, and hardening the kneaded product, it is possible to provide the conductive member which can approach a target resistance value of the electric resistance adjusting layer and prevent the loss of machining process property by adopting the advantages of the thermoplastic resin material of the low water absorption which tends to have the high resistance value and the thermoplastic resin of the high water absorption which tends to have the low resistance value.

Moreover, since the organic phosphonium salt, which hardly ion-dissociate and does not generate an alkaline material when it is ion-dissociated, is contained in the mixture product to be contained in the electric resistance adjusting layer, it is possible to obtain a target resistance value as the conductive member, and also prevent the deterioration in the resin because the alkaline material is not generated. Therefore, it is possible to prevent the temporal deterioration in the thermoplastic resin material when distributing power In accordance with an embodiment of the present invention, the mixture product is produced by kneading both of the thermoplastic resin materials in a melting condition, and hardening a kneaded product in the melting condition.

According to the above structure, the above effects can be further improved.

In accordance with an embodiment of the present invention, a thermoplastic resin, which contains a glycidylmethacrylate group as a compatible agent, is added to the kneaded product in the melting condition.

According to the above structure, it is possible to further approach the target resistance value as the conductive member. In addition, the strength in the weldline of electric resistance adjusting layer formed by the molding process can be improved, so it is possible to prevent the generation of crack resulting in the deterioration in the resin when repeating the power distribution or continuing the power distribution.

In accordance with an embodiment of the present invention, the electric resistance adjusting layer is used for adjusting a charging electric potential to be applied to an image carrier, and a pair of space retaining members, which retains a space formed between the image carrier and the surface protection layer, is provided in both end portions of the conductive supporting body, respectively.

According to the above structure, since the space retaining members are used to retain the non-contact state between the image carrier and the surface protection layer, it is possible to avoid the adhesion of the material comprising the conductive member to the image carrier and the deformation of conductive member caused by a long period of time nonuse.

In accordance with an embodiment of the present invention, each of the space retaining members is fastened to at least one of the conductive supporting body and the electric resistance adjusting layer.

According to the above structure, the relative rotation between the electric resistance adjusting layer and the space retaining member can be prevented when cutting the electric resistance adjusting layer and the space retaining member in the longitudinal direction of the electric resistance adjusting layer while rotating the conductive supporting body.

In accordance with an embodiment of the present invention, a primer process is applied to an adhesion plane of each of the space retaining members.

According to the above structure, it is possible to improve the strength that the space retaining member is adhered to at least one of the electric resistance adjusting layer and the conductive supporting body.

In accordance with an embodiment of the present invention, the conductive supporting body comprises a cylindrical shape.

According to the above structure, it is possible to prevent the local concentration of electric charge, so the conductive member life can be extended.

Also, the present invention is directed a charging member comprising a conductive member, and the conductive member, including: a long conductive supporting body to which a predetermined potential is applied, extending from one side to the other side; an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

According to the above structure, it is possible to apply stable charging potential to the image carrier for a long period of time.

Moreover, the present invention is directed to a charging member comprising a conductive member, and the conductive member, including: a long conductive supporting body to which a predetermined potential is applied, extending from one side to the other side; an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

According to the above structure, it is possible to apply stable charging potential to the image carrier for a long period of time.

Furthermore, the present invention is directed to a process cartridge comprising a charging member, the charging member including a conductive member, and the conductive member, including: a long conductive supporting body to which a predetermined potential is applied, extending from one side to the other side; an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

According to the above structure, it is possible to provide an exchangeable process cartridge.

Also, the present invention is directed to a process cartridge comprising a charging member, the charging member including a conductive member, and the conductive member, including: a long conductive supporting body to which a predetermined potential is applied, extending from one side to the other side; an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt According to the above structure, it is possible to provide an exchangeable process cartridge.

Moreover, the present invention is directed to an image forming apparatus comprising a process cartridge, the process cartridge including a charging member, the charging member including a conductive member, and the conductive member, including: a long conductive supporting body to which a predetermined potential is applied, extending from one side to the other side; an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

According to the above structure, it is possible to provide an image forming apparatus capable of obtaining a stable high quality image to a long period of time use.

Furthermore, An image forming apparatus comprising a process cartridge, the process cartridge including a charging member, the charging member including a conductive member, and the conductive member, including: a long conductive supporting body to which a predetermined potential is applied, extending from one side to the other side; an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

According to the above structure, it is possible to provide an image forming apparatus capable of obtaining a stable high quality image to a long period of time use.

It is to be understood that both the foregoing general description and the following detailed description are exemplary, and are intended to provide further explanation of the invention as claimed.

DESCRIPTION OF THE PREFERRED EMBODIMENTS

Hereinafter, embodiments of a conductive member, a charging member using the conductive member, a process cartridge using the charging member and an image forming apparatus using the process cartridge according to the present invention will be explained with reference to the accompanying drawings.

EMBODIMENTS

First Embodiment

Figure 1:
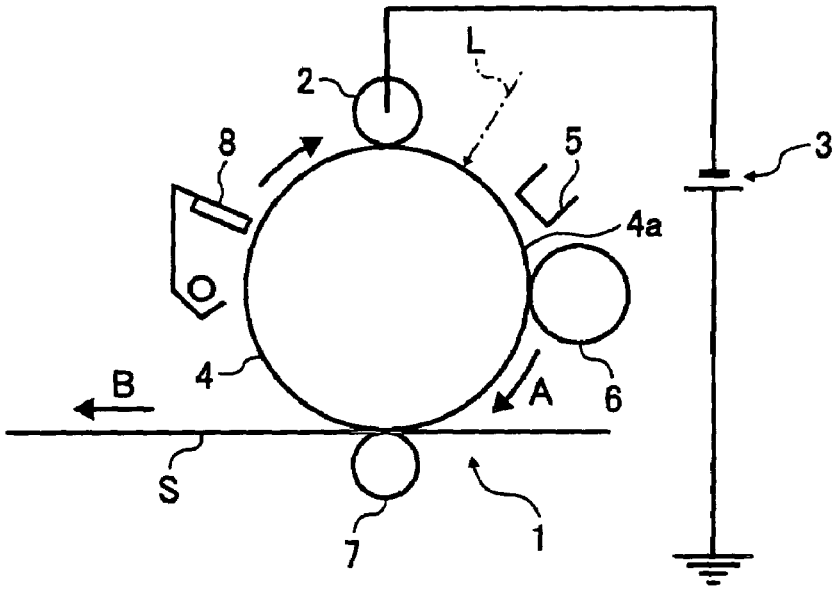
FIG. 1 is a schematic diagram illustrating a structure of general image forming apparatus.
Figure 2:
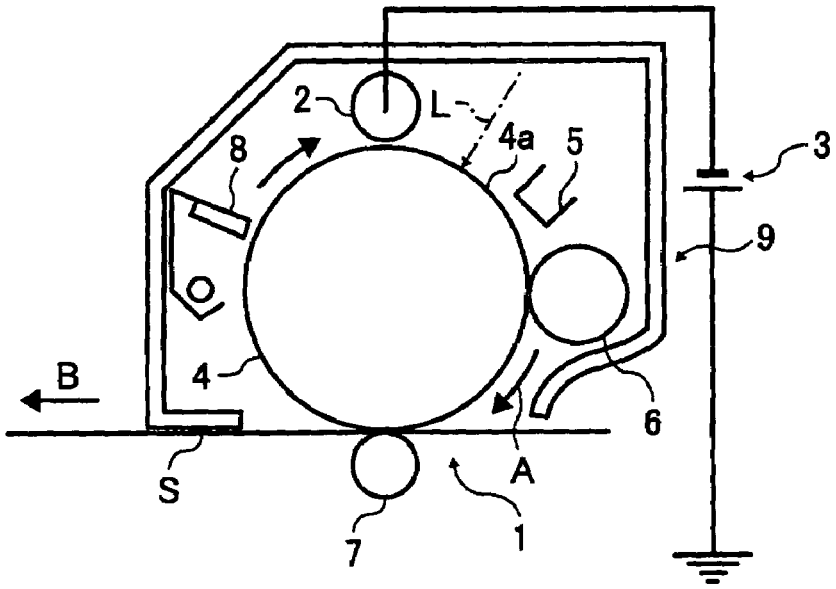
FIG. 2 is a schematic diagram illustrating a structure of image forming apparatus having a process cartridge.
Figure 3:
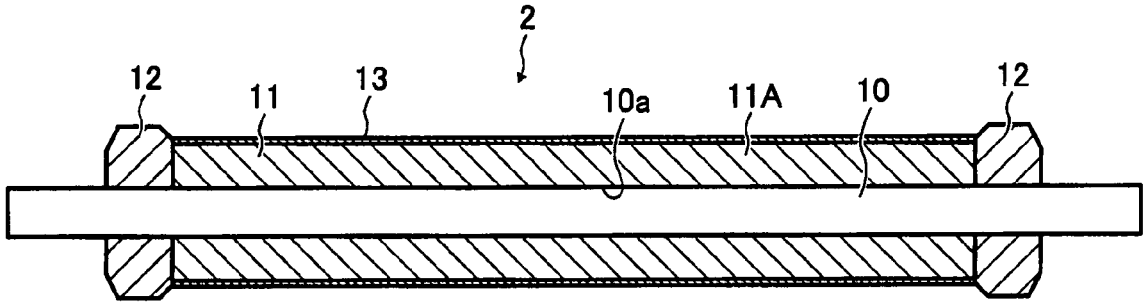
FIG. 3 is a vertical sectional view showing a conductive member according to the present invention.

FIG. 3 shows a structure of a conductive member which is used as a charging roller (charging member) 2 of an image forming apparatus 1. The schematic structure of image forming apparatus 1 is similar to that explained by using FIG. 1; thus, the explanation of structure of the image forming apparatus 1 is omitted. The charging roller 2 having a proximity charging method comprises a long conductive supporting body 10, extending from one side to the other side, to which predetermined potential is applied, and an electric resistance adjusting layer 11 which is formed to surround an outer circumference surface 10*a* of the conductive supporting body 10 and adjusts electric resistance. The conductive supporting body 10 has the end portions provided with a pair of space retaining members 12 which has contact with the end portions of the electric resistance adjusting layer 11, respectively.

Figure 4:
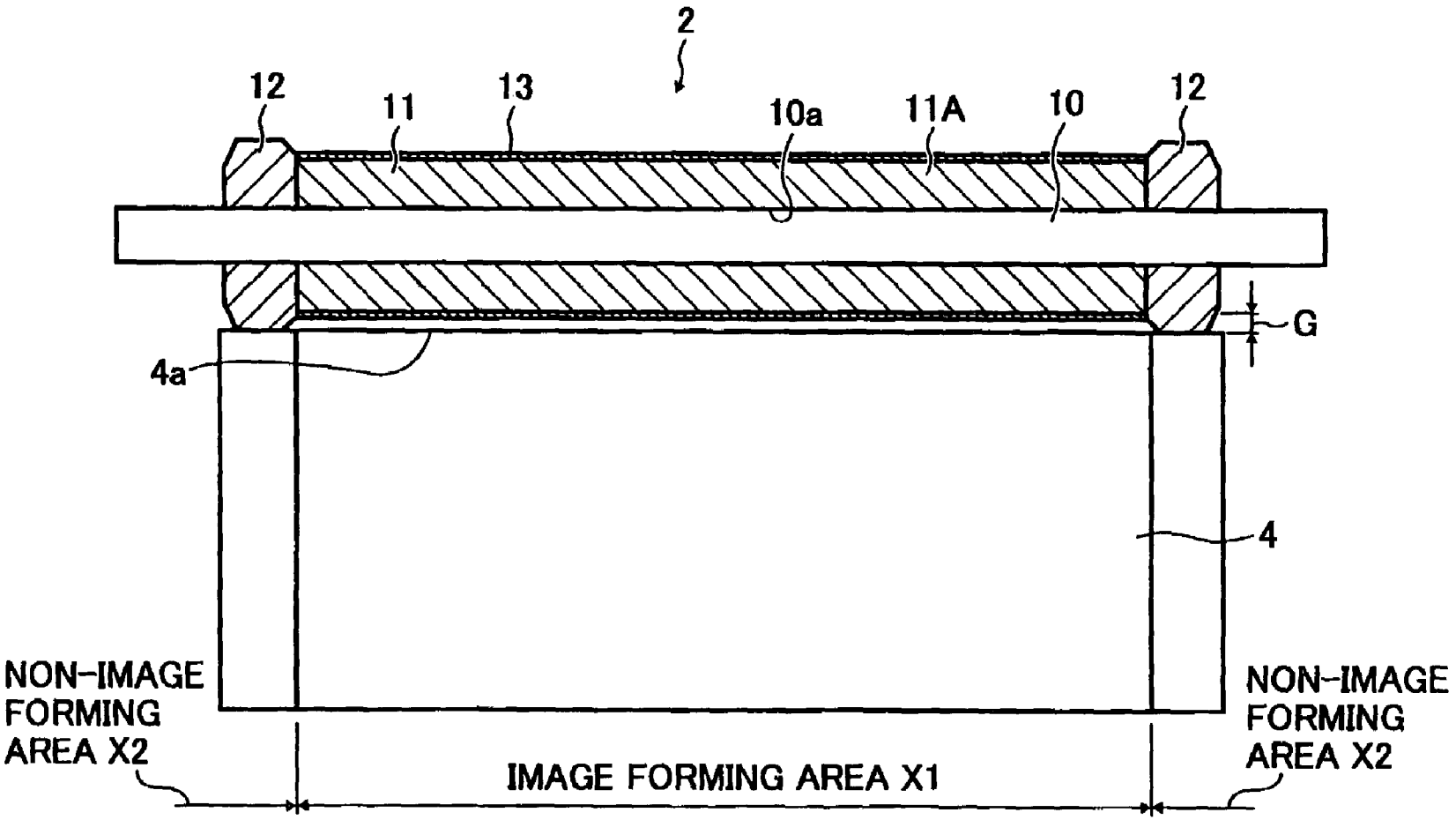
FIG. 4 is an explanation view illustrating facing relationship between a conductive member and a photoreceptor drum according to the present invention.

As shown in FIG. 4, a facing shaft portion 11A, which faces to a surface 4*a* of a photoreceptor drum 4 to maintain a predetermined space G, is provided between the pair of space retaining members 12. The space G is formed when the pair of space retaining members 12 has contact with the surface 4*a* of the photoreceptor drum 4 as an image carrier.

The conductive supporting body 10 comprises a cylindrical core, which is connected with a power pack (voltage applying source) 3 (reference to FIG. 1) for applying voltage to the charging roller 2. The electric resistance adjusting layer 11 comprises a cylindrical shape having the conductive supporting body 10 as its central core. A level difference is provided between each of the space retaining members 12 and the facing shaft portion 11A. The level difference is formed by cutting or grinding each of the space retaining members 12 and the electric resistance adjusting layer 11 while rotating the conductive supporting body 10. The facing shaft portion 11A is provided with a surface protection layer 13 comprising a resin layer of toner non-adhesive property.

Since the function of charging roller 2 (conductive member) deteriorates by adhesion of toner or adhesion of toner component, the surface protection layer 13 is formed to prevent such deterioration. The surface protection layer 13 is formed such that its electric resistance value becomes larger than the electric resistance value of the electric resistance adjusting layer 11. Thereby, voltage concentration to the defect portion of image carrier and abnormal discharge (leakage) are avoidable. However, if the electric resistance value of surface protection layer 13 is too high, the charging performance or the transfer performance decreases. Therefore, it is preferable for a difference of electric resistance value between the surface protection layer 13 and the electric resistance adjusting layer 11 to be less than or equal to $10^3$ cm. It is preferable to use a fluorine system resin, a silicone system resin, a polyamide resin, a polyester resin or the like as a material forming the surface protection layer 13, because these are superior to non-adhesive property and also preferable in terms of preventing the fixation of toner.

In addition, since the resin material electrically includes an insulation property, the electric resistance value of surface protection layer 13 is adjusted by dispersing various conductive materials to the resin material. In order to form the surface protection layer 13 onto the surface of electric resistance adjusting layer 11, the material used for forming the surface protection layer 13 is solved in an organic solvent to produce a coating material, and various coating methods such as spray painting, dipping or roll coating can be used. It is preferable for the thickness in the surface protection layer 13 to be 5 μm-30 μm.

Each of the space retaining members 12 is fastened to either the electric resistance adjusting layer 11 or the conductive supporting body 10. In case of fastening, it is desirable to apply a primer process such that each of the space retaining members 12 adheres firmly to at least one of the electric resistance adjusting layer 11 or the conductive member 10.

As an adhesive agent, various adhesive agents such as an epoxy system and a cyanoacrylate system can be used. However, it is desirable to use the cyanoacrylate system, which has a short hardening time, in terms of improving mass productivity.

In this case, the adhesive agent is used for preventing relative rotation of the electric resistance adjusting layer 11 and each of the space retaining members 12 when cutting the electric resistance adjusting layer 11 and each of the space retaining members 12 in the longitudinal direction of the conductive supporting member 10 while rotating the conductive supporting member 10.

FIG. 4 is a schematic view illustrating a state that the charging roller 2 shown in FIG. 3 is disposed adjacent to the photoreceptor drum 4. The charging roller 2 is disposed to have contact with the photoreceptor drum 4 with predetermined pressure. The charging roller 2 has the outer diameter of facing shaft portion 11A slightly smaller than the outer diameter of each of the space retaining members 12.

The outer circumference surface of each of the space retaining members 12 of the charging roller 2 has contact with the surface 4*a* of the photoreceptor drum 4. However, the space G is formed between the surface protection layer 13 and the surface 4*a* of the photoreceptor drum due to the level difference between each of the space retaining members 12 and the facing shaft portion 11A.

The charging roller 2 is disposed such that each of the space retaining members 12 has contact with a photosensitive layer coated area (non-image forming area X2) other than an image forming area X1 of the photoreceptor drum 4. In this state, if the voltage is applied to the charging roller 2, the image forming area X1 of the photoreceptor drum 4 is charged.

In this case, the photoconductive drum 4 comprises a cylindrical shape, but may comprise a belt shape. Also, the conductive member is not limited to the cylindrical shape, and may comprise an oval cylindrical shape, for example. However, it is preferable for the photoconductive drum 4 and the conductive member to comprise the cylindrical shape.

If the charging is performed in a state that the same surfaces of the conductive member and the photoreceptor drum 4 constantly face each other, a chemical change due to the power distribution stress is generated on the surface of conductive member and the surface 4*a* of the photoreceptor drum 4. However, if the charging roller 2 and the photoreceptor drum 4 comprise the cylindrical shape to rotate each other, the surfaces facing each other can be changed in accordance with the rotation.

It is preferable for the amount of space G between the facing shaft portion 11A and the surface 4*a* of the photoconductive drum 4 to have variations from one side to the other side of the facing shaft portion 11A less than or equal to 20 μm, so as to prevent the generation of image defect caused by uneven charging when forming an image.

The electric resistance adjusting layer 11 contains a thermoplastic resin material having an ether group in the molecule and an organic phosphonium salt. If a conductive agent of electron-conductive system such as a carbon black is used, the electric charge is discharged toward the image carrier through the carbon black. Thereby, minute uneven discharge easily occurs by the dispersion condition of carbon black; thus, a high quality image can not be obtained. Especially, an image defect tends to be generated by the uneven discharge when applying high voltage. Accordingly, an ionic conductive property is required.

The ionic conductive thermoplastic resin material includes a low-molecular-weight salt such as an alkali metal salt or an ammonium salt. However, these are polarizable by the power distribution, easily causing the bleeding out. Therefore, a high-molecular-form ionic conductive thermoplastic resin material containing a polyether group is used. The thermoplastic resin material containing a polyether group includes a polyether ester amide which is used as a polyamide elastomer. The polyether ester amide is a copolymer of a polyether and a polyamide. The ratio between the polyamide and the polyether can be freely selected. This polyether ester amide is the ionic conductive high-molecular material which hardly causes the leakage to the image carrier and the bleeding out onto the surface of matrix resin.

However, it is difficult to form the electric resistance adjusting layer 11 having a target electric resistance value by using only the ionic conductive thermoplastic resin material containing the ether group. Consequently, it is considered to manufacture the electric resistance adjusting layer 11 having a target low electric resistance value by using a salt together.

As the salt, a perchlorate is generally used, but it easily generates an alkaline material by the reaction with water; thereby, the thermoplastic resin layer easily deteriorates due to the generation of this alkaline material, causing a problem of durability of the conductive member. Consequently, the organic phosphonium salt is used instead of using the perchlorate. This organic phosphonium salt does not include an alkaline metallic material in the molecule, so the alkaline material is not generated.

It is desirable for the volume resistivity value of electric resistance adjusting layer 11 to be about $10^5$ Ωcm-$10^9$ Ωcm, because if the volume resistivity exceeds $10^9$ Ωcm, the charging potential, which is adequate for obtaining an even image, can not be applied to the photoreceptor drum 4 by the insufficient charging, and if the volume resistivity is lower than $10^5$ Ωcm and the photoreceptor drum 4 includes a defect portion, the voltage is concentrated to the defect portion, causing the abnormal discharge (leakage). It is more preferable for the target range of voltage resistivity value of the electric resistance adjusting layer 11 to be the range $10^5$ Ωcm-$10^6$ Ωcm. This is because the lower the variation in the volume resistivity value the lower the variation in the image quality.

The polyether ester amide has been used as a thermoplastic elastomer, but it is not suitable for a machining process because of its softness. Consequently, if a mixture product is produced by kneading a thermoplastic resin material having hardness higher than the polyether ester amide and the polyether ester amide in a melting condition, and by thermal-hardening the kneaded product of the melting condition, the electric resistance adjusting layer 11 having hardness higher than the hardness of electric resistance adjusting layer 11, which is produced by using only the polyether ester amide, can be produced. Accordingly, the machining properties of electric resistance adjusting layer 11 are improved. The thermoplastic resin material having hardness higher than the polyether ester amide includes a general-purpose resin such as a polyethylene resin, a polypropylene, a polymethylmethacrylate, an ABS, an polystyrene, or a compound thereof, or an engineering plastic such as a polycarbonate or polyacetal.

In terms of the weight ratio, it is desirable for the weight ratio of the thermoplastic resin having hardness higher than the high-molecular-weight ionic conductive thermoplastic material to be about 70% by weight—20% by weight relative to 30% by weight—80% by weight of the high-molecular-weight ionic conductive thermoplastic material, so as to approach a target volume resistivity.

It is desirable to add a compatible agent for improving the compatibility of both of the thermoplastic materials. As the compatible agent, it is preferable to use the compatible agent having many block graft copolymers and also a polycarbonate main chain or a polyolefin main chain, which chemically affects between the thermoplastic resins, for improving their compatibility. Especially, it is preferable to use the compatible agent having a glycidylmethacrylate (GMA) group as a reactive group.

It is preferable for the level difference between the surface of facing shaft portion 11A and each of the space retaining members 12 to be less than or equal to 100 μm. If the space G increases, the deterioration in the image carrier or the abnormal discharge easily occurs.

It is preferable for the volume resistivity of each of the space retaining members 12 to be greater or equal to $10^{13}$ Ωcm. If the volume resistivity is smaller than $10^{13}$ Ωcm, short current may be generated between the base layer of image carrier and each of the space retaining members 12 when each of the space retaining members 12 has contact with the image carrier.

In addition, it is not necessary for the entire space retaining member 12 to have an electric insulation property. As long as at least a part of the space retaining member 12 which has contact with the image carrier has the electric insulation property, the generation of shot current can be prevented. The material of space retaining member 12 is not specifically limited except for an insulation material, but it is desirable to use an olefin system resin such as a polyethylene resin, a fluorine resin or the like because of the reasons that these materials are soft, which does not damage the image carrier, the toner is hardly fixed to these materials and the like.

In particular, it is preferable to use a high density PE (polyethylene resin), a high-molecular-weight PE (polyethylene resin) or the like in terms of the toner non-adhesive property and the low abrasion property relative to the image carrier. In this case, for example, the olefin system resin is used as the resin material having the toner non-adhesive property. This resin material having the toner non-adhesive property has a property which hardly adheres. Therefore, when each of the space retaining members 12 is adhered to at least one of the electric resistance adjusting layer 11 and the conductive supporting body 10, it is preferable to previously apply the primer process with respect to a part of the space retaining member 12 which is adhered to at least one of the electric resistance adjusting layer 11 and the conductive supporting body 10, so as to eliminate the resin material of the toner non-adhesive property. Thereby, the adhesion defect of each of the space retaining members 12 relative to the electric resistance adjusting layer 11 and the conductive supporting member 10 can be prevented.

The conductive member is manufactured, for example, through a process of forming the electric resistance adjusting layer 11 on the outer circumference of cylindrical core as the conductive supporting body 10 by injection molding, a process of fastening the space retaining members 12 to which the primer process is previously performed to the both end portions thereof, a process of forming a constant level difference while solving the variations in the level difference by means of cutting or grinding the electric resistance adjusting layer 11 and each of the space retaining members 12 toward one end to the other end while rotating the conductive supporting body 10, and a process of forming the surface protection layer 13 on the outer circumference surface of electric resistance adjusting layer 11 to which the cutting or grinding process is performed.

electric resistance adjusting layer 11 is formed by performing the injection molding to the cylindrical core (conductive supporting body) 10 composed of SUM (Ni plated metal), which has 10 mm in outer diameter. After that, a part corresponding to a gate portion of the electric resistance adjusting layer 11 is cut to adjust the length of electric resistance adjusting layer 11.

Then, each of the ring shaped space retaining members 12 is pressed into the end portions of conductive supporting body 10, so as to closely fit to the both end portions of electric resistance adjusting layer 11. A high density polyethylene resin (Novatec PP HY540, Japan Polychem Corporation) is used for the ring shaped space retaining members 12. In some cases, the primer (PR550) process is previously performed to the space retaining members 12. After applying an adhesive agent (Alteco D) to the end portions of conductive supporting body 10, each of the space retaining members 12 is fastened to the end portions of conductive supporting body 10. After that, an annealing treatment is performed to reduce the stress and strain when molding. Next, each of the space retaining members 12 is finished to 12.5 mm in outer diameter and also the electric resistance adjusting layer 11 is finished to 12.4 mm in outer diameter by the cutting continuous process.

Next, the surface protection layer 13 having 10 μm in film thickness is formed on the surface of electric resistance adjusting layer 11 by spray-coating the mixture composed of an acrylsilicone resin (3000VH-P, Kawakami Paint), an isocyanate system hardener (Kawakami Paint) and a carbon black (25% by weight to total dissolved solid). After that, the conductive members according to the embodiments and comparative examples shown in the table 1 are obtained by heat-hardening the conductive members for 30 minutes at 80° C. with an oven.

TABLE 1

| | Thermoplastic Resin X1 | Thermoplastic Resin X2 | Thermoplastic Resin X3 | Self | Surface Protection Layer | Adhesion of Space Retaining Member | Primer | Resistance Value 100 V (Ω) | Permanence | General Evaluation |
|---|---|---|---|---|---|---|---|---|---|---|
| Embodiment 1 | TPAE H161(1) 60% by weight | ABS GR3000(7) 40% by weight | MODIPER CL440G(10) 4.5 | ETPP-FB(11) 3 | With | With | with | 1.5E+05 | ○ | ○ |
| Embodiment 2 | TPAE 10HP(1) 60% by weight | ABS GR3000(7) 40% by weight | MODIPER CL440G(10) 5 | ETPP-FB(11) 3 | With | With | with | 4.0E+06 | ○ | ○ |
| Embodiment 3 | MV3000(2) 60% by weight | ABS G500(7) 40% by weight | MODIPER A4400(10) 5 | PX-416FB(11) 5 | With | With | with | 1.0E+06 | ○ | ○ |
| Embodiment 4 | MV1041(2) 60% by weight | PC AD5503(8) 40% by weight | ROTADA AX8840(2) 5 | ETPP-1(11) 5 | With | With | with | 7.9E+05 | ○ | ○ |
| Comparative Example 1 | PELESTAT NO6321(3) 100% by weight | — | — | — | without | without | without | 1.3E+07 | — | X |
| Comparative Example 2 | IRGASTAT P16(4) 60% by weight | HYTREL 35482(9) 40% by weight | MODIPER A5400 (without GMA 10) | Perchloric Acid Na | without | without | without | 6.3E+06 | X | X |
| Comparative Example 3 | PA12 3014B(5) 100% by weight | — | — | Tetramethyl-ammonium Chloride | without | without | without | 1.0E+11 | — | X |
| Comparative Example 4 | PELESTAT 300(3) 70% by weight | POM M90 44(6) 30% by weight | — | — | Without | without | Without | 1.68+09 | — | X |

Hereinafter, it will be exampled for embodiments and comparative examples.

After kneading thermoplastic resins X1, X2, X3 and a salt shown in the following table 1 in a melting condition under each compounding ratio shown in the following table 1, the In the table 1, regarding each of the resins and the salts, (1) means the product of Fuji Kasei Kogyo Co., Ltd., (2) means the product of Arkema, Ltd., (3) means the product of Sanyo Chemical Industries, Ltd., (4) means the product of Chiba Specialty Chemicals, Co., Ltd., (5) means the product of Ube Industries, Ltd., (6) means the product of Polyplastics Co., Ltd., (7) means the product of Denki Kagaku Kogyo Kabushiki Kaisha, (8) means the product of Teijin Chemicals Ltd., (9) means the product of Du Pont-Toray Co., Ltd., (10) means the product of NOF Corporation, and (11) means the product of Nippon Chemical Industrial Co., Ltd.

Moreover, each of the thermoplastic resins X3 and each of the salts are expressed by weight (g) when the total weight of each of the thermoplastic resins X1 and each of the thermoplastic resins X2 is 100 g.

Furthermore, the marks or names in the table 1, TPAE H151, TPAE 10HP, MV3000, MV1041, PELESTAT NC6321, IRGASTAT P16, PA12 3014B and PELESTAT300 show the product names of thermoplastic resins X1, ABS GR3000, ABS GR500, PC AD5503, HYTREL 35482 and POM M90-44 show the product names of thermoplastic resins X2, MODIPER CL440G, MODIPER A4400, ROTADA AX8840 and MODIPER A5400 (without GMA) show the product names of thermoplastic resins X3, and ETPP-FB, PX-416FB, ETPP-I, perchloric acid Na and tetramethylammonium chloride show the product names of salts. In this case, ETPP-FB, PX-416FB and ETPP-I are organic phosphonium salts.

As a test 1, in both of the embodiments and comparative examples, after leaving the conductive member for 24 hours at a normal temperature and normal humidity, the conductive member is left for 24 hours at 10° C. and 15% relative humidity, and then the electric resistance value of conductive member is measured. After that, the conductive member is mounted on the image forming apparatus (imagio Neo C600, Ricoh Co., Ltd.) to conduct output of a half-tone image, and then the generation status of uneven charging is evaluated.

As a test 2, in both of the embodiments and comparative examples, the conductive member is mounted on the image forming apparatus (imagio Neo C600, Ricoh Co., Ltd.), and the applied voltage is set to DC=800V, AC=2.4 KVpp (frequency 2 KHz), and then the durability of conductive member is evaluated after conducting a passing paper test which passes through 300000 papers of A4 size. The evaluation environment conditions are 23° C. and 60% relative humidity. The durability of conductive member is judged whether or not a crack is generated to the electric resistance adjusting layer 11. In addition, as to the comparative examples 1, 3 and 4, the passing paper test is not continuously performed because the electric resistance value is too high; thus, the durability is not evaluated.

As apparent from the evaluation results, it is understood that each of the conductive members (embodiments 1-4) having the electric resistance adjusting layer 11, which contains the organic phosphonium salt, has a lower electric resistance value and also better durability compared with each of the conductive members (comparative examples 1-3) having the electric resistance layer 11, which does not contain the organic phosphonium salt.

Figure 5:
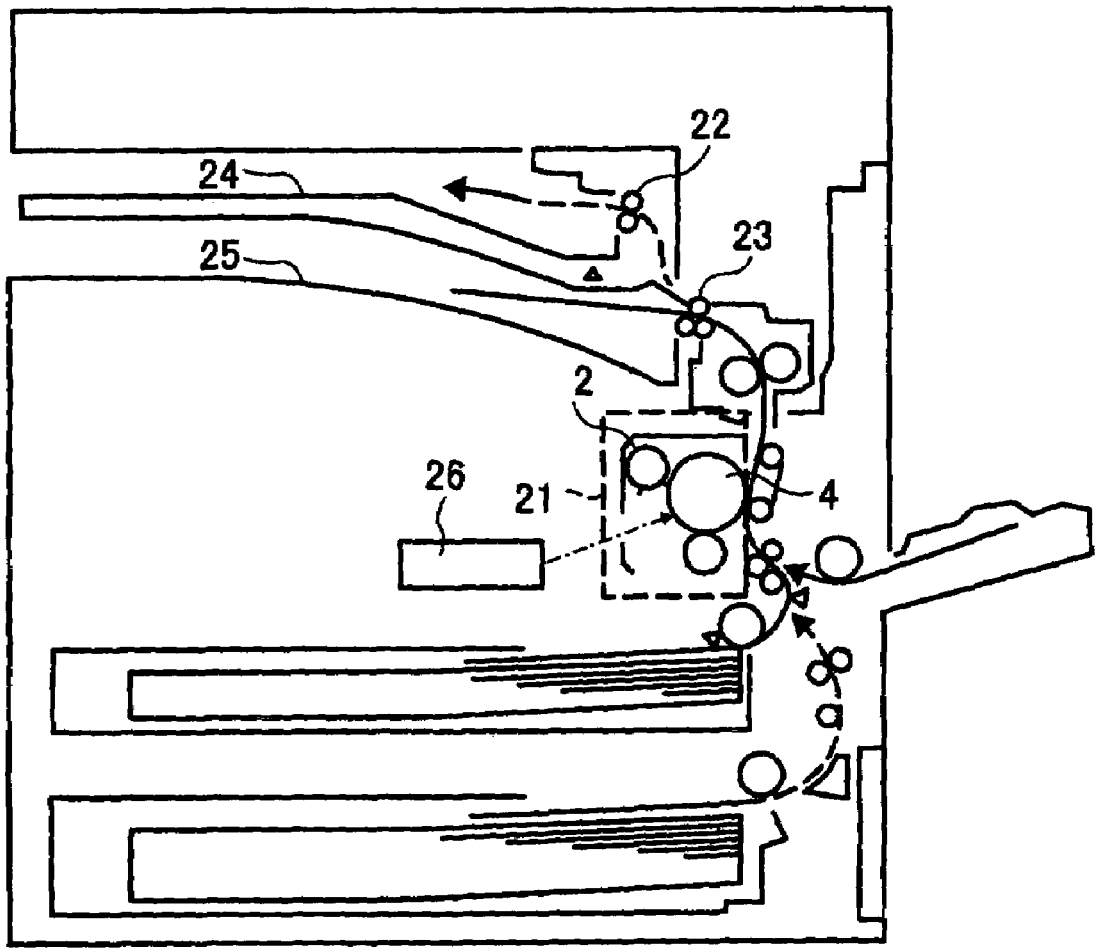
FIG. 5 is a schematic view showing an image forming apparatus on which a conductive member according to the present invention and a conductive member used for a comparative example are mounted.

In addition, the image forming apparatus has a well known structure. As shown in FIG. 5, the apparatus comprises a paper feeding portion in the lower portion of the apparatus body, an image forming portion 21 having a photoreceptor drum 4, etc., in the upper portion thereof, and paper discharging rollers 22, 23 in the upper portion thereof. The apparatus is configured to discharge a paper on a bin tray and a paper discharging tray 25. Each of the paper feeding steps is provided with a paper feeding roller. The photoreceptor drum 4 is written by a writing unit 26. A conductive member 2 as a charging roller is provided in contact with the outer circumference of the photoreceptor drum 4.

Embodiment 2

Figure 6:
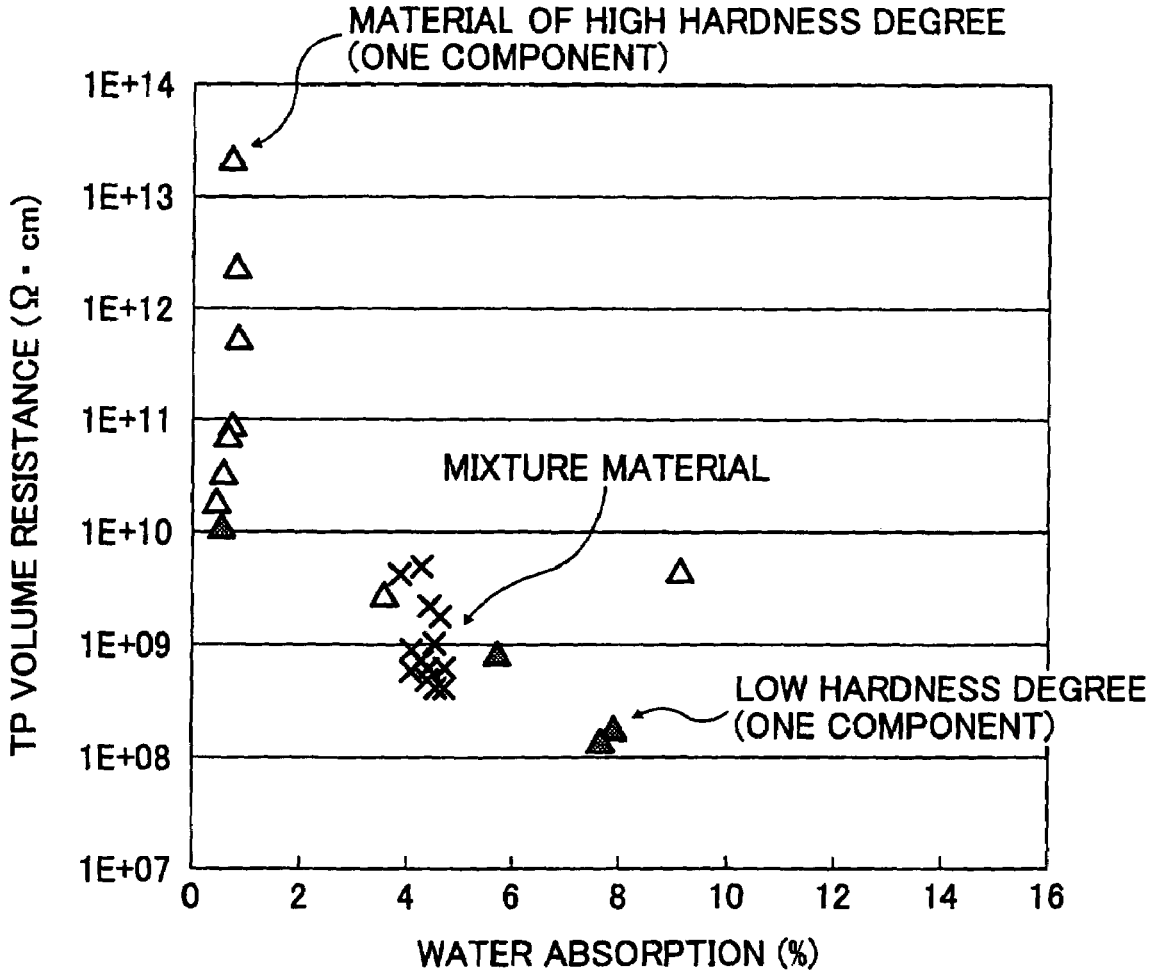
FIG. 6 is a graph showing relationship between water absorption and a volume resistivity value of each of thermoplastic resins.

FIG. 6 is a graph showing relationship between water absorption and a volume resistivity value of each of thermoplastic resins which has an ether group in the molecule. In FIG. 6, each of white rectangular marks shows a thermoplastic resin material having low water absorption of a single private company. As to the product of each of the private companies, the thermoplastic resin material having low water absorption generally tends to have a high volume resistivity value. Moreover, each of black rectangular marks shows a thermoplastic resin material having high water absorption of a singly private company. As to the product of each of the private companies, the thermoplastic resin material having high water absorption generally tends to have a low volume resistivity value. Each of marks, X shows a mixture product (so-called, blend product) which is produced by mixing the thermoplastic resin material having low water absorption and the thermoplastic resin material having high water absorption at a melting condition. As apparent from the graph shown in FIG. 6, since the water absorption of each of the mixture products is situated near the intermediate between the two and the volume resistivity value of each of the mixture products is also situated near the intermediate between the two, each of the mixture products obtains a volume resistivity value close to the target volume resistivity value.

Therefore, if the electric resistance adjusting layer is formed by using the mixture product which is produced by kneading the thermoplastic resin material of low water absorption having the ether group in the molecular and the thermoplastic resin of high water absorption having the ether group in the molecular in the melting condition, and hardening the kneaded product, the conductive member which can approach the target resisitivity value of the electric resistance adjusting layer and also prevent the loss of machining process property by adopting both of the thermoplastic resin, which tends to have low water absorption and a high resistivity value, and the thermoplastic resin, which tends to have high water absorption and a low resistivity value.

All of the mixture products shown in FIG. 6 essentially contain the organic phosphonium salt. Incidentally, the material composition of the mixture product is ABS/PEEA/compatible agent/phosphonium salt. The ratio is 40/60/4.5/3. When blending the PEEA by the ratio of 50/50, the above 60 becomes 30/30.

More particularly, if the thermoplastic resin containing the glycidylmethacrylate group as the compatible agent is added to the kneaded product in the melting condition, the conductive member can further approach a target resistivity value, and also the strength in the weldline of electric resistance adjusting layer formed by a molding process can be improved. Accordingly, it is possible to prevent the generation of crack caused by the repetition of power distribution or the deterioration in the resin when the power is continuously distributed.

If the electric resistance adjusting layer 11 is used to adjust the charging potential to be applied to the image carrier, and the space retaining members 12 which retain the space by forming the space between the image carrier and the surface protection layer 13 are provided in the both end portions in the direction that the conductive supporting body 10 extends, the non-contact state between the image carrier and the surface protection layer 13 can be maintained by using the space retaining members 12. Therefore, it is possible to avoid the adhesion of the material comprising the conductive member to the image carrier and also the deformation of conductive member caused by a long period of time nonuse.

Moreover, if each of the space retaining members 12 is fastened to at least one of the conductive supporting body 10 and the electric resistance adjusting layer 11, the electric resistance adjusting layer 11 and each of the space retaining members 12 can be prevented from relatively rotating when cutting the outer circumference surface of the electric resistance adjusting layer 11 and the outer circumference surface of each of the space retaining members 12 along the longitudinal direction of the conductive supporting body 10 while rotating the conductive supporting body 10.

If the primer process is performed to the adhesion plane of each of the space retaining members 12, the adhesive strength of each of the space retaining members 12 to at least one of the electric resistance adjusting layer 11 and the conductive supporting body 10 can be improved.

If the conductive supporting body comprises a cylindrical shape, the local concentration of electric charge can be prevented. Accordingly, it is possible to extend the conductive member life.

The conductive member can be used as the charging member, and also a process cartridge incorporated with the charging member can be mounted on the image forming apparatus.

Although the present invention has been described in terms of exemplary embodiments, it is not limited thereto. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

The present application is based on and claims priorities from Japanese application No. 2005-326049, filed on Nov. 10, 2005, the disclosures of which are hereby incorporated by reference herein in their entirety.

What is claimed is:

1. A conductive member, comprising:

a long conductive supporting body to which a predetermined potential is applied, extending from one side to the other side;

an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt.

2. The conductive member according to claim 1, wherein the thermoplastic resin material having the ether group comprises a polyether ester amide.

3. The conductive member according to claim 1, wherein the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

4. The conductive member according to claim 3, wherein a thermoplastic resin, which contains a glycidylmethacrylate group as a compatible agent, is added to the kneaded product in the melting condition.

5. The conductive member according to claim 3, wherein the conductive supporting body comprises a cylindrical shape.

6. The conductive member according to claim 1, wherein a resin layer having a toner non-adhesive property is used for the surface protection layer.

7. The conductive member according to claim 1, wherein the electric resistance adjusting layer is used for adjusting a charging electric potential to be applied to an image carrier, and a pair of space retaining members, which retains a space formed between the image carrier and the surface protection layer, is provided in both end portions of the conductive supporting body, respectively.

8. The conductive member according to claim 7, wherein each of the space retaining members is fastened to at least one of the conductive supporting body and the electric resistance adjusting layer.

9. The conductive member according to claim 8, wherein a primer process is applied to an adhesion plane of each of the space retaining members.

10. A conductive member, comprising:

a long conductive supporting body to which a predetermined potential is applied, extending from one side to the other side;

an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

11. The conductive member according to claim 10, wherein the mixture product is produced by kneading both of the thermoplastic resin materials in a melting condition, and hardening a kneaded product in the melting condition.

12. The conductive member according to claim 11, wherein a thermoplastic resin, which contains a glycidylmethacrylate group as a compatible agent, is added to the kneaded product in the melting condition.

13. The conductive member according to claim 10, wherein the electric resistance adjusting layer is used for adjusting a charging electric potential to be applied to an image carrier, and a pair of space retaining members, which retains a space formed between the image carrier and the surface protection layer, is provided in both end portions of the conductive supporting body, respectively.

14. The conductive member according to claim 13, wherein each of the space retaining members is fastened to at least one of the conductive supporting body and the electric resistance adjusting layer.

15. The conductive member according to claim 14, wherein a primer process is applied to an adhesion plane of each of the space retaining members.

16. The conductive member according to claim 10, wherein the conductive supporting body comprises a cylindrical shape.

17. A charging member comprising a conductive member, and the conductive member, including:

a long conductive supporting body to which a predetermined potential is applied, extending from one side to the other side;

an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

18. A charging member comprising a conductive member, and the conductive member, including:

a long conductive supporting body to which a predetermined potential is applied, extending from one side to the other side;

an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

19. A process cartridge comprising a charging member, the charging member including a conductive member, and the conductive member, including:

a long conductive supporting body to which a predetermined potential is applied, extending from one side to the other side;

an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

20. A process cartridge comprising a charging member, the charging member including a conductive member, and the conductive member, including:

a long conductive supporting body to which a predetermined potential is applied, extending from one side to the other side;

an electric resistance adjusting layer which is formed to surround a circumference surface of the conductive supporting body and adjusts an electric resistance; and a surface protection layer which is disposed to cover a surface of the electric resistance adjusting layer and protects the surface of the electric resistance adjusting layer, wherein the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

21. An image forming apparatus comprising a process cartridge, the process cartridge including a charging member, the charging member including a conductive member, and the conductive member, including:

a long conductive supporting body to which a predetermined potential is applied, extending from one side to the other side;

an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer comprises a mixture product of the thermoplastic resin material having the ether group and a thermoplastic resin material, which has a hardness higher than that of the thermoplastic resin material having the ether group, and the mixture product is produced by kneading both of the thermoplastic resin materials in a melting condition, and hardening a kneaded product in the melting condition.

22. An image forming apparatus comprising a process cartridge, the process cartridge including a charging member, the charging member including a conductive member, and the conductive member, including:

a long conductive supporting body to which a predetermined potential is applied, extending from one side to the other side;

an electric resistance adjusting layer, which is formed to surround a circumference surface of the conductive supporting body and adjusts an electric resistance; and a surface protection layer, which is provided to cover a surface of the electric resistance adjusting layer and protects the surface of the electric resistance adjusting layer, wherein the electric resistance adjusting layer contains a thermoplastic resin material having an ether group in a molecular and an organic phosphonium salt, and the electric resistance adjusting layer contains a mixture product of a thermoplastic resin material of low water absorption, which has an ether group in a molecular, and a thermoplastic resin material of high water absorption, which has an ether group in a molecular, and an organic phosphonium salt.

* * * * *